United States Patent [19]

Tomohiro

[11] Patent Number: 4,671,304

[45] Date of Patent: Jun. 9, 1987

[54] AUTOMATIC HAIR CURLER

[76] Inventor: Mohri Tomohiro, 1-10-15 Kotobuki, Taito-ku, Tokyo, Japan, 111

[21] Appl. No.: 922,471

[22] Filed: Oct. 23, 1986

[51] Int. Cl.[4] ..... A45D 2/14

[52] U.S. Cl. ..... 132/42 A

[58] Field of Search ..... 132/40, 42, 46, 48

[56] References Cited

U.S. PATENT DOCUMENTS

| | | | |
|---|---|---|---|
| 2,584,698 | 2/1952 | Hammerschmidt | 132/42 R |
| 2,828,752 | 4/1958 | Pileggi et al. | 132/42 R |
| 3,696,820 | 10/1972 | Laru | 132/40 |
| 3,933,161 | 1/1976 | Strickman | 132/40 |

*Primary Examiner*—Gregory E. McNeill

*Attorney, Agent, or Firm*—Calif Kip Tervo

[57] ABSTRACT

An automatic hair curler comprising, in general, a U-shaped frame, a fixed shaft extending across the open top of the frame, a curling drum idly journaled on the shaft, a coil spring for energy storage, and ratchets to control drum rotation and coil winding. In use, the coil spring is pre-wound; hair tips are clamped to the drum; and the drum ratchet is disengaged, thereby allowing the spring to turn the drum thus curling the hair. An over-winding protection feature prevents excessive spring tension. A spring ratchet assembly, connected to the right arm, is connected to the spring inner end for controlling the coiling of the spring. The spring ratchet assembly has an engaged position permitting coiling of the spring and wherein rotation of the drum does not cause rotation of the spring inner end, and a disengaged position allowing the spring inner end to rotate and to uncoil the spring independent of drum rotation. A drum ratchet, connected to the left arm and engaging the drum, has an engaged position preventing the drum from rotating so as to uncoil the spring, and a disengaged position allowing the drum to rotate so as to coil the spring.

11 Claims, 5 Drawing Figures

A-A

B-B

C-C

AUTOMATIC HAIR CURLER

CROSS-REFERENCE TO RELATED APPLICATION

This is the United States patent application for the same invention of application filed in Japan on Aug. 26, 1986 by the same inventor and titled "Marvel Rod".

BACKGROUND OF THE INVENTION

1. Field of the Invention

This invention relates in general to hair curling devices and more particularly to a pre-energized automatic hair curler used in permanents.

2. Background of the Invention

When hair is permanently waved (permed) by conventional methods, hair is divided into portions and curled on forty to sixty rollers. This is time-consuming and cumbersome work because the curlers must be rotated to roll up the hair and then fastened in some manner.

Also, it is desirable to shorten curler application time because the chemicals applied to the hair are already at work.

Therefore there has been a need for a curling device that greatly shortens the time required for curling hair, particularly the time of direct application of the curlers.

It is also desirable that such a device save on labor.

It is also desirable that such a device be highly resistant to chemicals.

It is also desirable that such a device be light and handy in use.

SUMMARY OF THE INVENTION

According to the invention, an automatic hair curler comprises, in general, a U-shaped frame, a fixed shaft extending across the open top of the frame, a curling drum idly journaled on the shaft, a coil spring for energy storage, and ratchets to control drum rotation and coil winding.

The U-shaped frame comprises left and right arms, each having a base end and a top end, and a rod connecting the base ends. The fixed shaft extends between the top ends.

The hair curling drum comprises a curling portion having a hollow portion at the right end housing the spring, and a clamping member connected to the curling portion for holding hair tips to the curling portion. The hollow portion includes a plurality of notches on its inner periphery. The spring outer end engages one of the notches and, upon over-tightening of the spring to a prescribed tensile force, disengages, slips, and rotates to engage another notch to prevent breakage.

The spring ratchet assembly, connected to the right arm, is connected to the spring inner end for controlling the coiling of the spring. The spring ratchet means has an engaged position permitting coiling of the spring and wherein rotation of the drum does not cause rotation of the spring inner end, and a disengaged position allowing the spring inner end to rotate and to uncoil the spring independent of drum rotation.

A drum ratchet, connected to the left arm and engaging the drum, has an engaged position preventing the drum from rotating so as to uncoil the spring, and a disengaged position allowing the drum to rotate so as to coil the spring.

In use, the spring is pre-coiled by rotating the drum or a spring ratchet wheel. This can be done by hand or more quickly by applying either the drum or the spring ratchet wheel to a rotating wheel. Clamping the hair and releasing the drum ratchet allows the drum to rotate, thus winding the hair around it. Excess tension on the hair stems is relieved by releasing the spring ratchet. Also the spring ratchet is released to remove the curler from the hair.

As can be seen, the invention replaces conventional manual work and automatically curls hair by utilizing the rotating energy retained in the curler, thereby shortening the time and reducing labor required for curling hair.

The invention does not require pinning in place once the hair is wound on the drum.

The use of chemical resistant parts and the overwinding prevention feature result in a practioal curler that can be used repeatedly.

Other features and many attendant advantages of the invention will become apparent upon a reading of the following detailed description together with the drawings, in which like reference numerals refer to like parts throughout.

DETAILED DESCRIPTION OF THE INVENTION

Figure 1:
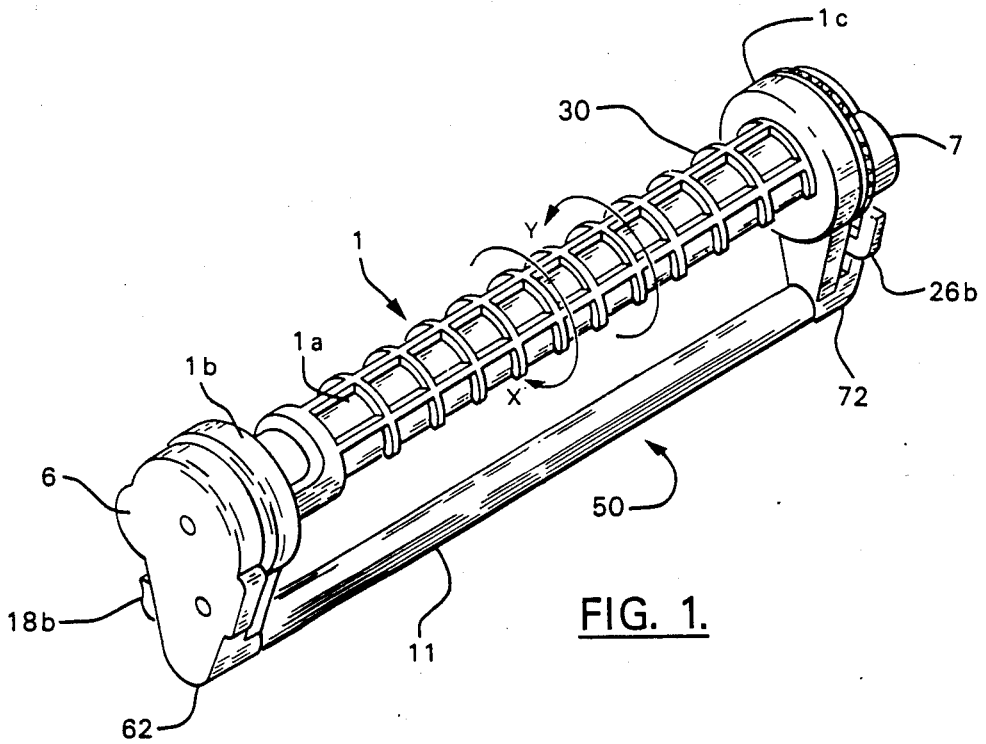
FIG. 1 is a perspective view of the preferred embodiment of the automatic hair curler of the present invention.

With reference now to the drawing, and more particularly to FIG. 1 thereof, there is shown a perspective view of a preferred embodiment of the automatic hair curler, denoted generally as 40, of the present invention. Unless otherwise noted, the components of curler 40 are preferable made of synthetic resin. In general, curler 40 is comprised of a U-shaped frame, shown generally as 50, which supports a hair curling drum, shown generally as 1. Frame 50 comprises, in general, left arm 6, right arm 7, and a connecting member, such as connecting rod or tube 11, which extends between, and joins, the bases 62,72 of the arms 6,7 respectively. Arm bases 62,72 include projecting pins 31,32 which mate with the connecting tube inner bore 11*a*.

Figure 2:
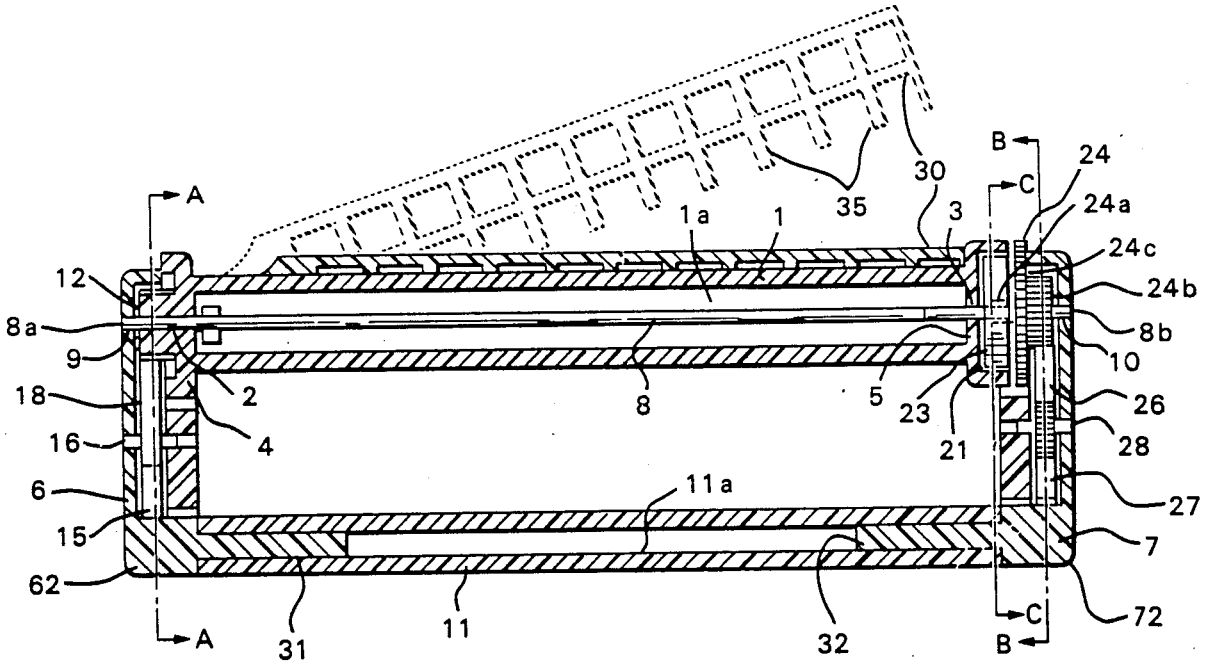
FIG. 2 is a front view in vertical section.

As best illustrated in FIG. 2, curling drum 1 includes hair curling portion 1*a*, which is a tube extending substantially between arms 6,7. Curling portion 1*a* terminates on each end with a flanged collar peripheral a central bearing. The left end terminates in flanged collar 1*b* and left bearing 4. Left bearing 4 covers the end of the hollow core of curling portion 1*a* and includes an outer bearing face. The right end of curling portion 1*a* terminates in peripheral flanged collar 1*c* and central right bearing 5. Right bearing 5 covers the right end of the hollow core of curling portion 1*a* and includes a bearing face on its right side. Axial bearing holes 3,3 pass thru bearings 4,5.

Stainless steel shaft 8 passes thru curling portion 1*a* thru bearing holes 3,3 such that curling portion 1*a* is idly journaled and freely rotates on shaft 8. Shaft 8 includes ends 8*a*,8*b* which protrude outwardly from bearings 4,5 of curling portion 1*a*. Shaft ends 8*a*,8*b* are driven into and fixedly retained in fixing holes 9,10 in end arms 6,7 respectively.

Drum 1 also includes means for holding hair to the drum including a hair holding member, such as clamp 30. In the preferred embodiment, clamp 30 is hinged at one end to the outer periphery of curling portion 1*a* enabling it to swing open as shown by the phantom lines in FIG. 2 for accepting hair to be curled. Clamp 30 includes suitable detent means, such as resilient fingers 35 which grip curling portion 1*a*, to hold the clamp in the closed position.

Figure 3:
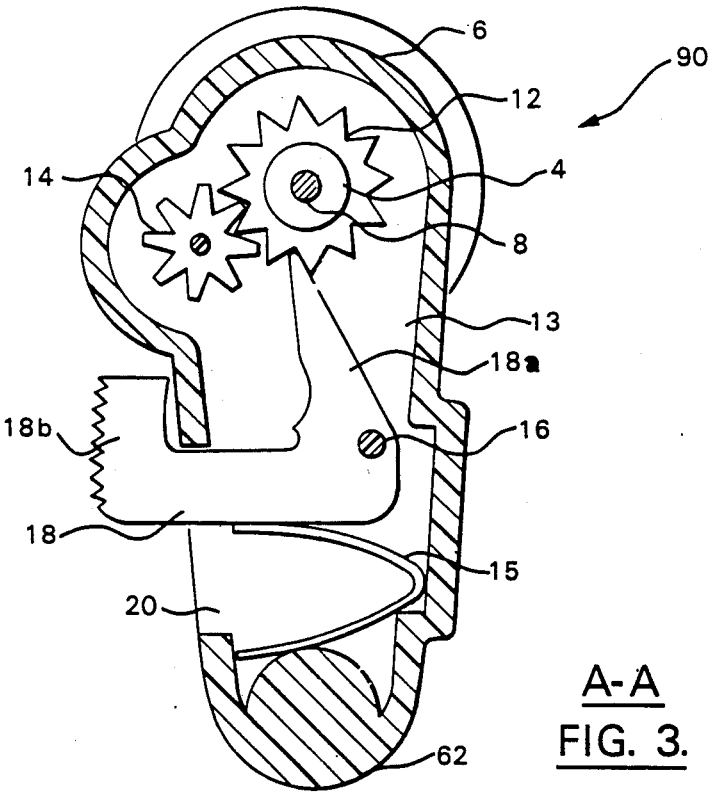
FIG. 3 is an enlarged cross-sectional view taken along line A—A of FIG. 2.

As best seen in FIGS. 2 and 3, mounted within a hollow 13 in left end arm 6 is drum ratchet means for at least partially controlling the rotation of drum 1. The drum ratchet means includes stop wheel 12, idle gear 14, pawl 18, and pawl biasing means, such as spring 15. Stop wheel 12 includes teeth on its periphery and it is fastened to or is integral with left bearing 4 and therefore rotates with drum 1. Idle gear 14, freely journaled on arm 6, is engaged with stop wheel 12. Pawl 18 is freely journaled on arm 6 with mounting pivot 16. Pawl 18 has an engaging end 18*a* for engaging the teeth of stop wheel 12 and a release end 18*b*, which extends out of arm 6 thru side opening 20 for accessibility to the user. The workings and function of the drum ratchet are further explained later in this description.

Figure 4:
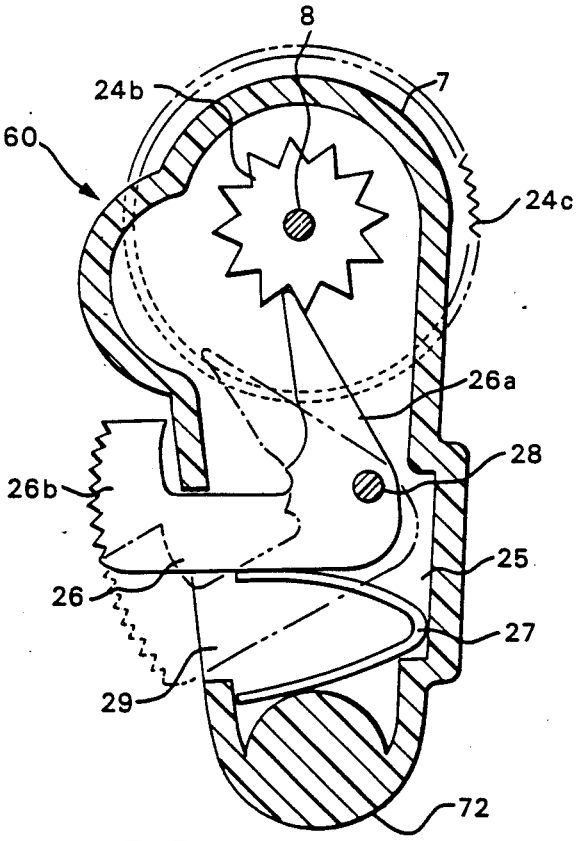
FIG. 4 is an enlarged cross-sectional view taken along line B—B of FIG. 2.
Figure 5:
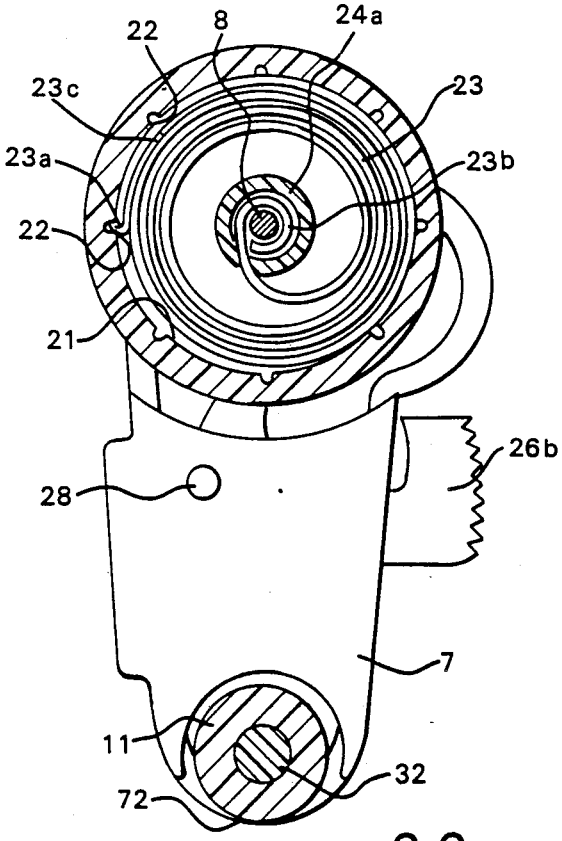
FIG. 5 is an enlarged cross-sectional view taken along line C—C of FIG. 2.

With reference now to FIGS. 3,4, and 5, the mechanisms of right arm 7 are shown, including spring ratchet means and spring over-coil prevention means. With more specific reference to FIG. 5, on the right end of curling portion 1*a*, flanged collar 1*c*, extends rightward past bearing 5. The inner periphery of collar 1*c* defines a hollow drum portion 21 which houses coil spring 23 to the right of bearing 5. Spring 23 is preferably of stainless steel. Spring 23 includes outer end 23*a*, inner end 23*b*, and folded outer portion 23*c*. A plurality of engaging notches 22 for receiving spring outer end 23*a* are located on the inner periphery of hollow drum portion 21. In the exemplary embodiment, eight engaging notches 22 are equally spaced about the inner periphery at a given radius from shaft 8. Coil spring 23 is housed in hollow drum portion 21 in a manner such that outer end 23*a* thereof is engaged in one of engaging notches 22 and inner end 23*b* is attached to shaft portion 24*a* of spring gear 24. The outer end of coil spring 23 includes outward biasing force means, such as folded outer portion 23*c*, to maintain outer end 23*a* in contact with the inner periphery of hollow drum 21. Folded outer portion 23*c* consists of the end portion of coil spring 23 being partially folded back on itself to the inside where it bears against the innernext coil and thus exerts an outward force on outer end 23*a*.

Turning now primarily to FIGS. 2 and 5, there is shown spring gear 24, which is idly journaled to shaft 8 between bearing 5 and fixing hole 10. Spring gear 24 consists of three integral sections. On the left side, as already partially described above, is shaft portion 24*a*. Shaft portion 24*a* projects into the center of hollow drum 21 and is attached to coil spring 23.

Figur 4 illustrates the operator-accessible spring ratchet assembly, denoted generally as 80. On the right end of spring gear 24 is spring ratchet wheel 24*b*, which is part of a spring ratchet assembly including spring ratchet pawl 26 and pawl biasing means, such as spring 27. These components are located in a hollow 25 in right arm 7. Pawl 26 is idly journaled on mounting pivot 28. Pawl engaging end 26*a* engages spring ratchet wheel 24*b* and release end 26*b* protrudes from arm 7 thru opening 29 for activation by the user. As shown in phantom lines in FIG. 4, downward movement of pawl release end 26*b* causes engaging end 26*a* to move from contact with spring ratchet wheel 24*b*.

As seen in FIGS. 2 and 4, the central portion of spring gear 24 is toothed spring winding wheel 24*c*. Spring winding wheel 24*c* protrudes thru an opening in the top of arm 7 so that it is accessible to the operator.

The automatic hair curler 40 functions as follows. Coil spring 23 is wound or coiled by rotating drum 1 in the X direction or by rotating winding wheel 24*c* in the Y direction. This may be done by hand or by pressing a rotary drum to both collars 1*b*,1*c* or to winding wheel 24*c*. The spring ratchet assembly 80 prevents spring 23 from uncoiling from the inside and drum ratchet assembly 90 prevents drum 1 from rotating and uncoiling spring 23 from the outside. Thus, in this manner, energy can be stored in the spring 23. As a safety mechanism to prevent damage due to excessive spring tightening, coil spring outer end 23*a* disengages from one engaging notch 22 and slides along the inner periphery of hollow drum 21 until the holding force exerted by folded portion 23*c* exceeds the rotation force. The sliding outer end then engages in another notch 22 to unwind slightly the spring. This sliding produces a clicking sound which indicates to the operator that the spring is fully wound.

To employ the accumulated spring energy, clamp 30 is opened, hair tips are interposed between clamp 30 and curling portion 1*a*, and clamp 30 is closed. Drum ratchet release end 18*b* is operated to disengage release end 18*b* from stop wheel 12, thereby allowing drum 1 to rotate in the Y direction which curls the held hair onto the drum 1. Upon disengagement from stop wheel 12, pawl release end 18*b* is engaged by idle gear 14 which prevents the release end 18*b* from returning to engage the stop wheel 12 until stop wheel 12 is rotated in the X direction. Thus, once drum 1 is released by moving pawl 18, pawl release end 18*b* need now be continuously held for drum 1 to turn in the X direction.

To release curled hair from drum 1, engaging end 26*a* of spring ratchet pawl 26 is held disengaged from ratchet wheel 24*b*. This allows the inner end 23*b* of coil spring 23 to freely rotate and therefore drum 1 also to freely rotate in the X direction whereby the curled hair will be unwound as the curler 40 is moved away. The spring inner end may also be released in this manner to remove unnecessary tension on the roots of the curled hair if the spring is still exerting considerable curling force after the curler 40 has stopped moving.

From the foregoing description, it is seen that the present invention provides an extremely fast, efficient, compact and reliable manner of automatically curling hair.

Although a particular embodiment of the invention has been illustrated and described, modifications and changes will become apparent to those skilled in the art, and it is intended to cover in the appended claims such modifications and changes as come within the true spirit and scope of the invention.

What I claim is:

1. An automatic hair curler comprising:

a U-shaped frame comprising:

a left arm having a base end and a top end;

a right arm having a base end and a top end; and a rod connecting said base ends;

a hair curling drum rotatably mounted between said top ends comprising:
a curling portion; and
a clamping member connected to said curling portion for holding hair tips to said curling portion; and
a coil spring having:
a first end engaging said drum; and
a second end; and
spring ratchet means connected to one of said arms and connected to said spring second end for controlling the coiling of said spring; said spring ratchet means having:
an engaged position permitting coiling of said spring and wherein rotation of said drum does not cause rotation of said spring second end; and
a disengaged position allowing said spring second end to rotate and to uncoil said spring independent of drum rotation; and
drum ratchet connected to on one of said arms and engaging said drum; said drum ratchet means having:
an engaged position preventing said drum from rotating so as to uncoil said spring; and
a disengaged position allowing said drum to rotate so as to coil said spring.

2. The automatic hair curler of claim 1 wherein said spring ratchet means includes:
a spring gear idly mounted on said shaft and having:
a shaft portion connected to said spring second end; an
a winding wheel accessible to a user for rotating said shaft portion thereby rotating said spring second end for coiling said spring.

3. The automatic hair curler of claim 1 including:
spring over-coiling prevention means for preventing over-coiling of said spring.

4. The automatic hair curler of claim 1 wherein:
said curling portion has a right end defining a hollow portion housing said spring.

5. The automatic hair curler of claim 4 wherein:
said hollow portion has an inner periphery and said spring first end is an outer end and engages said inner periphery.

6. The automatic hair curler of claim 5 wherein:
said inner periphery includes at least one notch therein; and
said spring outer end engages in said notch, thereby allowing said spring to coil, and disengages from said notch when said spring is coiled a predetermined amount.

7. An automatic hair curler comprising:
a U-shaped frame comprising:
a left arm having a base end and a top end;
a right arm having a base end and a top end; and
a rod connecting said base ends;
a fixed shaft extending between said top ends;
a hair curling drum idly journaled on said shaft between said top ends comprising:
a curling portion; and
a clamping member connected to said curling portion for holding hair tips to said curling portion; and
a coil spring having:
a first end engaging said drum; and
a second end; and
spring ratchet means connected to one of said arms and connected to said spring second end for controlling the coiling of said spring; said spring ratchet means having:
an engaged position permitting coiling of said spring and wherein rotation of said drum does not cause rotation of said spring second end; and
a disengaged position allowing said spring second end to rotate and to uncoil said spring independent of drum rotation; and
drum ratchet means connected to one of said arms and engaging said drum; said drum ratchet means having:
an engaged position preventing said drum from rotating so as to uncoil said spring; and
a disengaged position allowing said drum to rotate so as to coil said spring.

8. The automatic hair curler of claim 7 wherein:
said spring ratchet means is mounted on one arm; and
said drum ratchet means is mounted on the other arm.

9. The automatic hair curler of claim 7 wherein:
one of said arms is a right arm;
said spring ratchet means is connected to said right arm;
said drum has a right end defining a collar having a hollow portion housing said spring;
said spring first end is an outer end engaged with said collar; and
said spring second end is an inner end.

10. The automatic hair curler of claim 9 wherein:
said spring ratchet means includes:
a spring gear idly journaled on said shaft including:
a shaft portion connected to said spring inner end;
a ratchet wheel connected to said shaft portion; and
user operable pawl means for at least partially controlling the rotation of said ratchet wheel.

11. The automatic hair curler of claim 10 wherein:
said spring gear includes:
a winding wheel accessible to a user for rotating said shaft portion thereby rotating said spring inner end for coiling said spring.

* * * * *